US010309721B2

(12) United States Patent
Howard

(10) Patent No.: US 10,309,721 B2
(45) **Date of Patent: *Jun. 4, 2019**

(54) SYSTEM AND METHOD FOR ENHANCED ARGON RECOVERY FROM A FEED STREAM COMPRISING HYDROGEN, METHANE, NITROGEN AND ARGON

(71) Applicant: Henry E. Howard, Grand Island, NY (US)

(72) Inventor: Henry E. Howard, Grand Island, NY (US)

(73) Assignee: PRAXAIR TECHNOLOGY, INC., Danbury, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/107,204

(22) Filed: Aug. 21, 2018

(65) Prior Publication Data

US 2018/0356152 A1 Dec. 13, 2018

Related U.S. Application Data

(63) Continuation of application No. 15/453,942, filed on Mar. 9, 2017, now Pat. No. 10,072,890.

(Continued)

(51) Int. Cl.
*F25J 3/02* (2006.01)
*F25J 5/00* (2006.01)

(52) U.S. Cl.
CPC ..... *F25J 3/0285* (2013.01); *F25J 3/0219* (2013.01); *F25J 3/0223* (2013.01); *F25J 3/0233* (2013.01);

(Continued)

(58) Field of Classification Search
CPC .... F25B 3/0285; F25B 3/0252; F25B 3/0219; F25B 3/0257; F25B 3/0276; F25B 3/04587; F25B 3/0675; F25B 3/068; F25B 2210/20; F25B 2215/20; C01B 3/02; C01B 3/025; C01B 2203/04; C01B 2203/046

See application file for complete search history.

(56) References Cited

U.S. PATENT DOCUMENTS 3,442,613 A * 5/1969 Grotz, Jr. ..... C01B 3/025 252/374
3,614,872 A 10/1971 Tassoney et al.

(Continued)

OTHER PUBLICATIONS

W. H. Isalski, "Separation of Gases", Clarendon Press—Oxford 1989, pp. 84-89.

(Continued)

*Primary Examiner* — Brian M King
(74) *Attorney, Agent, or Firm* — Robert J. Hampsch

(57) ABSTRACT

A system and method for argon and nitrogen extraction from a feed stream comprising hydrogen, methane, nitrogen and argon, such as tail gas of an ammonia production plant is provided. The disclosed system and method provides for nitrogen-argon rectification and the methane rejection within a column system comprised of at least one distillation column. Nitrogen and argon are further separated and to produce liquid products. An argon stripping column arrangement is disclosed where residual argon is further removed from the methane-rich fuel gas and recycled back to the feed stream.

17 Claims, 6 Drawing Sheets

Related U.S. Application Data

(60) Provisional application No. 62/311,149, filed on Mar. 21, 2016.

(52) U.S. Cl.
CPC ..... *F25J 3/0257* (2013.01); *F25J 3/0276* (2013.01); *F25J 5/005* (2013.01); *F25J 2200/04* (2013.01); *F25J 2200/06* (2013.01); *F25J 2200/30* (2013.01); *F25J 2200/34* (2013.01); *F25J 2200/38* (2013.01); *F25J 2200/72* (2013.01); *F25J 2200/74* (2013.01); *F25J 2200/76* (2013.01); *F25J 2200/78* (2013.01); *F25J 2210/04* (2013.01); *F25J 2210/20* (2013.01); *F25J 2215/04* (2013.01); *F25J 2215/20* (2013.01); *F25J 2215/42* (2013.01); *F25J 2215/58* (2013.01); *F25J 2230/04* (2013.01); *F25J 2230/20* (2013.01); *F25J 2230/30* (2013.01); *F25J 2235/58* (2013.01); *F25J 2235/60* (2013.01); *F25J 2240/02* (2013.01); *F25J 2240/12* (2013.01); *F25J 2245/02* (2013.01); *F25J 2260/60* (2013.01); *F25J 2270/02* (2013.01); *F25J 2270/04* (2013.01); *F25J 2270/42* (2013.01); *F25J 2290/34* (2013.01)

(56) References Cited

U.S. PATENT DOCUMENTS

| | | | | |
|---|---|---|---|---|
| 3,675,434 | A * | 7/1972 | Crawford | C01B 3/506 62/630 |
| 5,775,128 | A * | 7/1998 | Drnevich | C01B 3/025 62/632 |
| 6,620,399 | B1 | 9/2003 | Jungerhans | |
| 7,090,816 | B2 | 8/2006 | Malhotra et al. | |
| 8,307,671 | B2 * | 11/2012 | Jungerhans | F25J 3/0219 423/359 |
| 10,024,595 | B2 | 7/2018 | Howard | |
| 2017/0234612 | A1 | 8/2017 | White et al. | |

OTHER PUBLICATIONS

Bhakta, M., Grotz, B., Gosnell, J., Madhavan, S., "Techniques for Increase Capacity and Efficiency of Ammonia Plants", Ammonia Technical Manual 1998.

* cited by examiner

SYSTEM AND METHOD FOR ENHANCED ARGON RECOVERY FROM A FEED STREAM COMPRISING HYDROGEN, METHANE, NITROGEN AND ARGON

CROSS REFERENCE TO RELATED APPLICATIONS

The present application is a continuation application of U.S. patent application Ser. No. 15/453,942 filed on Mar. 9, 2017 that claims the benefit of and priority to U.S. patent application Ser. No. 62/311,149 filed on Mar. 21, 2016.

TECHNICAL FIELD

The present invention relates to a system and method for separating a feed stream comprising hydrogen, nitrogen, methane and argon, and more particularly, a system and method for argon recovery from a feed stream originating from an ammonia production plant via: (i) rectification of the feed stream to produce an argon depleted nitrogen enriched vapor stream, an argon enriched stream, and a methane-rich liquid stream; (ii) separation of argon and nitrogen in an auxiliary rectification column; and (iii) residual argon stripping from the methane rich liquid.

BACKGROUND

Argon is a highly inert element used in high-temperature industrial processes, such as steel-making. Argon is also used in various types of metal fabrication processes such as arc welding as well as in the electronics industry, for example in silicon crystals production. Still other uses of argon include medical, scientific, preservation and lighting applications. While argon constitutes only a minor portion of ambient air (i.e. 0.93% by volume), it possesses a relatively high value compared to other major atmospheric constituents (oxygen and nitrogen) which may be recovered from air separation plants. Argon is typically recovered in a cryogenic air separation process as a byproduct of high purity oxygen production. In such processes, an argon rich vapor draw from the lower pressure column is directed to an argon rectification column where crude or product grade argon is recovered overhead.

The availability of low cost natural gas has led to the restart and construction of numerous ammonia production facilities throughout North America. One of the byproducts of ammonia production plants is a tail gas that may be comprised of methane, nitrogen, argon, and hydrogen. This tail gas is often utilized as fuel to fire various reactors within the ammonia production plant. However, if this argon-containing tail gas can be cost-effectively handled and purified, it could be used as an alternative source of argon production.

Ammonia is typically produced through steam methane reforming. In such a process air serves to auto-fire the reaction and to supply nitrogen for the synthesis reaction. In general, the steam methane reforming based process consists of primary steam reforming, secondary 'auto-thermal' steam reforming followed by a water-gas shift reaction and carbon dioxide removal process to produce a synthesis gas. The synthesis gas is subsequently methanated and dried to produce a raw nitrogen-hydrogen process gas (i.e. synthesis gas) which is then fed to an ammonia synthesis reaction. In many ammonia production plants, the raw nitrogen-hydrogen process gas is often subjected to a number of purification or additional process steps prior to the ammonia synthesis reaction. In one such purification process, the methane contained in the nitrogen-hydrogen process gas is cryogenically rejected prior to the nitrogen-hydrogen process gas compression. The rejected gas is a tail gas comprising the bulk of the contained methane as well as argon, nitrogen and some hydrogen. This tail gas is often used as a fuel to supply the endothermic heat of reaction to the primary steam reformer.

Argon is present in ammonia tail gas generally contains between about 3% to 6% argon. After hydrogen recovery from the tail gas, the relative concentration of argon increases to between about 12% to 20% argon which makes the argon recovery an economically viable process. In an effort to reduce costs and increase process efficiency, the conventional argon recovery processes from ammonia tail gas are typically integrated with the hydrogen recovery process. The conventional argon recovery processes are relatively complex and involves multiple columns, vaporizers, compressors, and heat exchangers, as described for example in W. H Isalski, "*Separation of Gases*" (1989) pages 84-88. Other relatively complex argon recovery systems and process are disclosed in U.S. Pat. Nos. 3,442,613; 5,775,128; 6,620,399; 7,090,816; and 8,307,671.

What is needed, however, is a much simpler and cost-effective system and method for the recovery of argon and nitrogen contained within the tail gas of an ammonia production plant as an alternative source of argon production and/or liquid nitrogen production.

SUMMARY OF THE INVENTION

The present invention may be characterized as a method for separating a feed stream comprised primarily of hydrogen, nitrogen methane and argon comprising the steps of: (a) conditioning the feed stream to a temperature suitable for distillation at pressure less than or equal to about 400 psia (and preferably less than 150 psia); (b) directing the conditioned feed stream to a rectification column; (c) separating the conditioned feed stream in the at least one rectification column to produce an argon depleted nitrogen enriched vapor stream, an argon enriched stream, and a methane-rich liquid stream; (d) directing the methane rich liquid stream into an argon stripping column configured to strip argon from the methane rich liquid stream using a nitrogen rich vapor stream; (e) directing the nitrogen rich vapor stream into the stripping column at a feed point below methane rich liquid stream such that mass transfer of argon is effected between the methane rich liquid stream and the nitrogen rich vapor stream; (f) extracting an argon depleted methane rich liquid from the bottom of the stripping column and an argon containing overhead gas; and (g) recovering purified argon from the argon containing overhead gas. The argon containing overhead gas may be recycled back to and combined with the feed stream and may be warmed and/or optionally compressed prior to mixing or recombining the argon containing overhead gas with the feed stream.

The present invention may also be characterized as a system. for separating a feed stream comprising hydrogen, nitrogen, methane and argon comprising: (i) a conditioning circuit or system configured for conditioning the feed stream gas to a temperature suitable for rectification and at pressure less than or equal to about 400 psia and more preferably less than or equal to about 150 psia; (ii) a rectifying column configured to receive the conditioned feed stream and produce an argon depleted nitrogen enriched vapor stream, an argon enriched stream, and a methane-rich liquid stream; (iii) an argon stripping column configured to receive the methane rich liquid stream and strip argon from the methane rich liquid stream using a nitrogen rich vapor stream and produce an argon depleted methane rich liquid from the bottom of the argon stripping column and an argon containing overhead gas; (iv) a recycle circuit configured for extracting the argon from the argon containing overhead gas from the argon stripping column and mixing the argon containing overhead gas with the feed stream; and (v) an auxiliary rectification column configured to rectify the argon enriched stream to produce a high purity argon stream and a high purity nitrogen stream.

The feed stream to the overall process may be a gas stream, a two phase stream, or a liquid stream. Preferably, the feed stream is a tail gas from an ammonia plant and may generally contain greater than about 50% nitrogen by mole fraction. Conditioning of the feed stream in the refrigeration system may involve cooling the feed stream; prepurification of the feed stream, warming/vaporizing the feed stream, compressing and/or expanding the feed stream in a plurality of discrete steps. Where the system and method are integrated or coupled to an ammonia plant, recycling of one or more of the streams back to the ammonia plant is contemplated. For example, the argon-depleted, hydrogen-nitrogen gas overhead may be recycled back to the ammonia plant, and preferably recycled back to either a cryogenic purifier in the ammonia plant or other locations within the synthesis gas stream of the ammonia plant. The argon-depleted methane-rich liquid is also preferably recycled back to the ammonia plant, and preferably employed as a high quality fuel gas to be used for example to fire the reformers in the ammonia plant.

As indicated above, the rectification column separates the conditioned feed stream to produce an argon depleted nitrogen enriched vapor stream, an argon enriched stream, and a methane-rich liquid stream. The argon-depleted nitrogen enriched rich vapor stream preferably comprises mainly nitrogen and hydrogen vapor. The argon enriched stream, on the other hand may be a liquid stream, a gaseous stream or a two phase stream comprising a fraction of liquid argon and a fraction of gaseous argon. In either state, trace amounts of hydrogen may be removed or rejected from this stream using a hydrogen rejection arrangement such as an evaporator, phase separator, or a hydrogen stripping column. The resulting hydrogen-free, argon enriched stream is then directed to an auxiliary rectification column where it is separated to produce a high purity argon stream and a high purity nitrogen stream. The argon depleted nitrogen enriched vapor is preferably split into two or more portions with a first portion being directed as the nitrogen rich vapor stream used in the argon stripping column. Another portion of the of the argon depleted nitrogen enriched vapor may be combined with the argon depleted methane rich liquid stream.

BRIEF DESCRIPTION OF THE DRAWINGS

While the specification concludes with claims specifically pointing out the subject matter that Applicant regards as the invention, it is believed that the invention will be better understood when taken in connection with the accompanying drawings in which;

For sake of clarity, many of the reference numerals used in FIGS. 4-6 are similar in nature such that the same reference numeral in one figure corresponds to the same item, element or stream as in the other figures.

DETAILED DESCRIPTION

The following detailed description provides one or more illustrative embodiments and associated methods for separating a feed stream comprising hydrogen, nitrogen, methane and argon into its major constituents. The disclosed system and methods are particularly suitable for gas recovery from a tail gas of an ammonia production plant comprising hydrogen, nitrogen, methane and inert gases, such as argon krypton and xenon, and involves four (4) key steps or subsystems, namely: (i) conditioning the feed gas stream in a refrigeration circuit or subsystem; (ii) separating the conditioned feed gas stream in a rectification column to produce a methane-rich liquid column bottoms; an argon-depleted, hydrogen-nitrogen gas overhead; and an argon-rich stream having trace amounts of hydrogen; (iii) stripping the trace amounts of hydrogen from the argon-rich stream to produce an argon depleted stream and a hydrogen-free, nitrogen and argon containing stream; and (iv) separating the argon from the hydrogen-free, nitrogen and argon containing stream in a distillation column system to produce at least an argon product stream and a nitrogen product stream.

Figure 1:
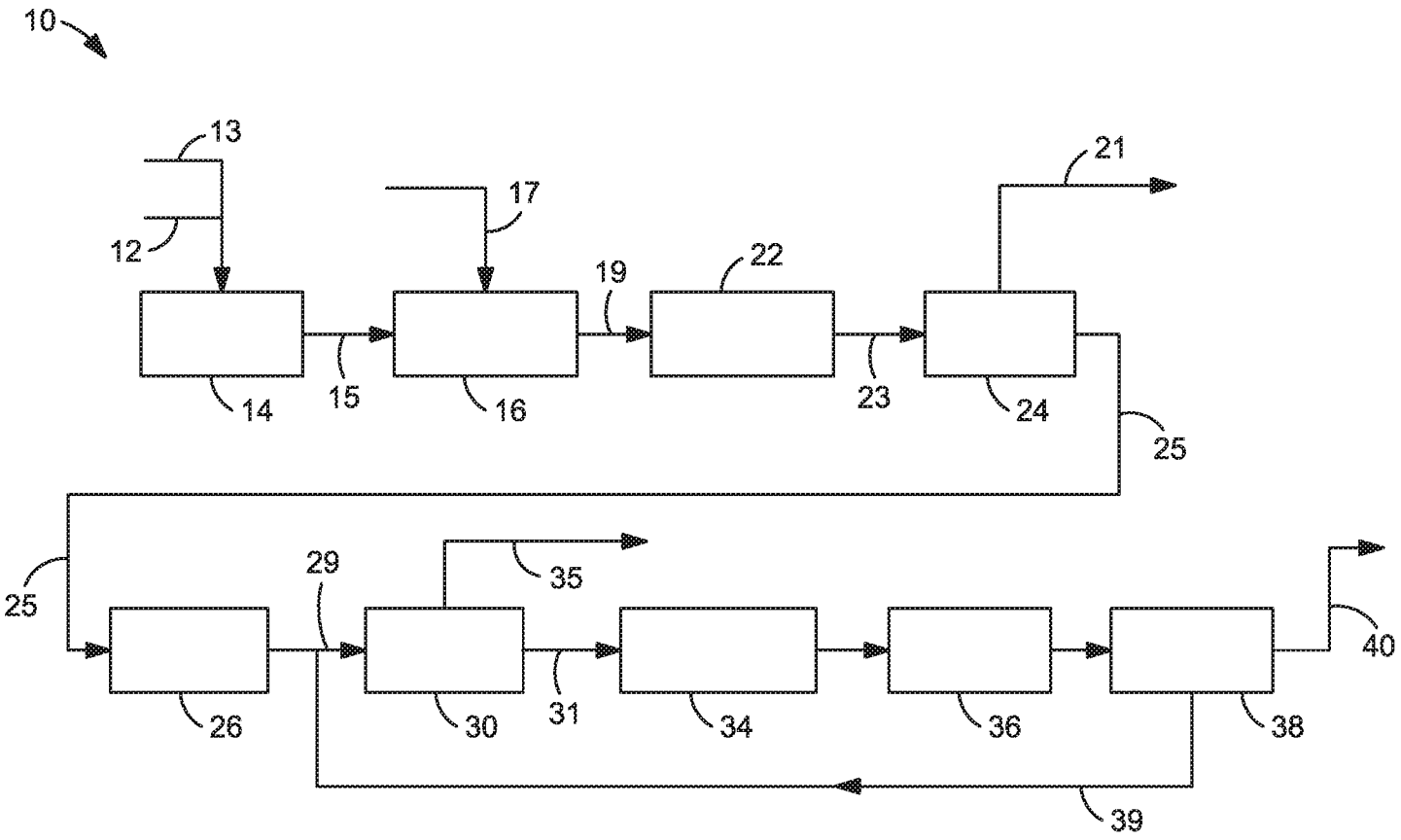
FIG. 1 is a schematic representation of an ammonia synthesis process used in a typical ammonia plant.

Turning now to FIG. 1, a schematic representation of an ammonia production plant 10 is shown. The production of ammonia from hydrocarbons entails a series of unit operations which include catalytic, heat exchange and separation processes. In general, ammonia synthesis proceeds by steam reforming of a hydrocarbon feed 12 and steam 13 in a primary reformer 14, typically methane. A secondary reformer 16 is generally employed wherein the synthesis gas mixture 15 is further reformed in the presence of an air feed 17. The air feed 17 serves to provide a source of oxygen to fire the reforming reaction as well as to supply the necessary nitrogen for subsequent ammonia conversion. After reforming, the synthesis gas 19 is directed to several stages of heat recovery and catalytic water gas shift reaction 22. The gas 23 is then directed to a carbon dioxide removal process 24 generally known to persons skilled in the art such as MDEA, hot potassium carbonate, etc. to remove carbon dioxide as effluent 21. The resulting carbon dioxide free gas 25 is then further subjected to methanation 26 to remove residual carbon oxides. A number of further processing arrangements including cryogenic purification 30 and synthesis gas compression 34 are further employed to facilitate final ammonia synthesis 36 which involves a high temperature and high pressure reaction (~140 bar). Ammonia 40 is then separated or recovered 38 by subsequent cooling and condensation. A recycle stream 39 from the ammonia recovery process is then directed back to the cryogenic purifier 30

A common part of the ammonia processing train employs a cryogenic purification process 30 known by those skilled in the art as the "Braun Purifier". Since the secondary reformer 16 is fed with an air flow that is larger than that required by the stoichiometry of the ammonia synthesis reaction, excess nitrogen and inert gases must be removed or rejected prior to the ammonia synthesis step 36. In order to reject the excess nitrogen and inerts, a cryogenic purification process 30 is introduced after the methanation 26 reaction. The primary purpose of this cryogenic purification process 30 is to generate an overhead ammonia synthesis gas stream 31 with a stoichiometric ratio of hydrogen to nitrogen (H2:N2) of about 3:1. The cryogenic purification step of the Braun Purifier employs a single stage of refrigerated rectification. The overhead synthesis gas stream from the single stage of refrigerated rectification is free of unconverted methane and a substantial portion of the inerts, such as argon, are rejected into the fuel gas stream-bottoms liquid. In the Braun Purifier process, the feed gas stream 29 is first cooled and dehydrated. The feed gas stream 29 is then partially cooled and expanded to a lower pressure. The feed gas stream 29 may be further cooled to near saturation and then directed to the base of the single stage rectifier. The rectifier overhead is the resulting ammonia synthesis gas 31 that is processed for ammonia synthesis, whereas the rectifier bottoms are partially vaporized by passage through the rectifier condenser and warmed to ambient temperatures. This fuel/waste stream 35 is typically directed back to the reform and serves as fuel. See Bhakta, M., Grotz, B., Gosnell, J., Madhavan, S., "Techniques for Increase Capacity and Efficiency of Ammonia Plants", Ammonia Technical Manual 1998, which provides additional details of this Braun Purifier process. The waste gas 33 from the Braun Purifier process step is predominantly a mixture of hydrogen (6.3 mole %), nitrogen (76.3 mole %), methane (15.1 mole %) and argon (2.3 mole %) The Braun Purifier waste gas 35 represents a distinct departure from typical ammonia plant tail gas streams and requires new techniques and processes for recovering valuable constituents of the waste gas in a simple, cost effective and efficient manner.

Figure 2:
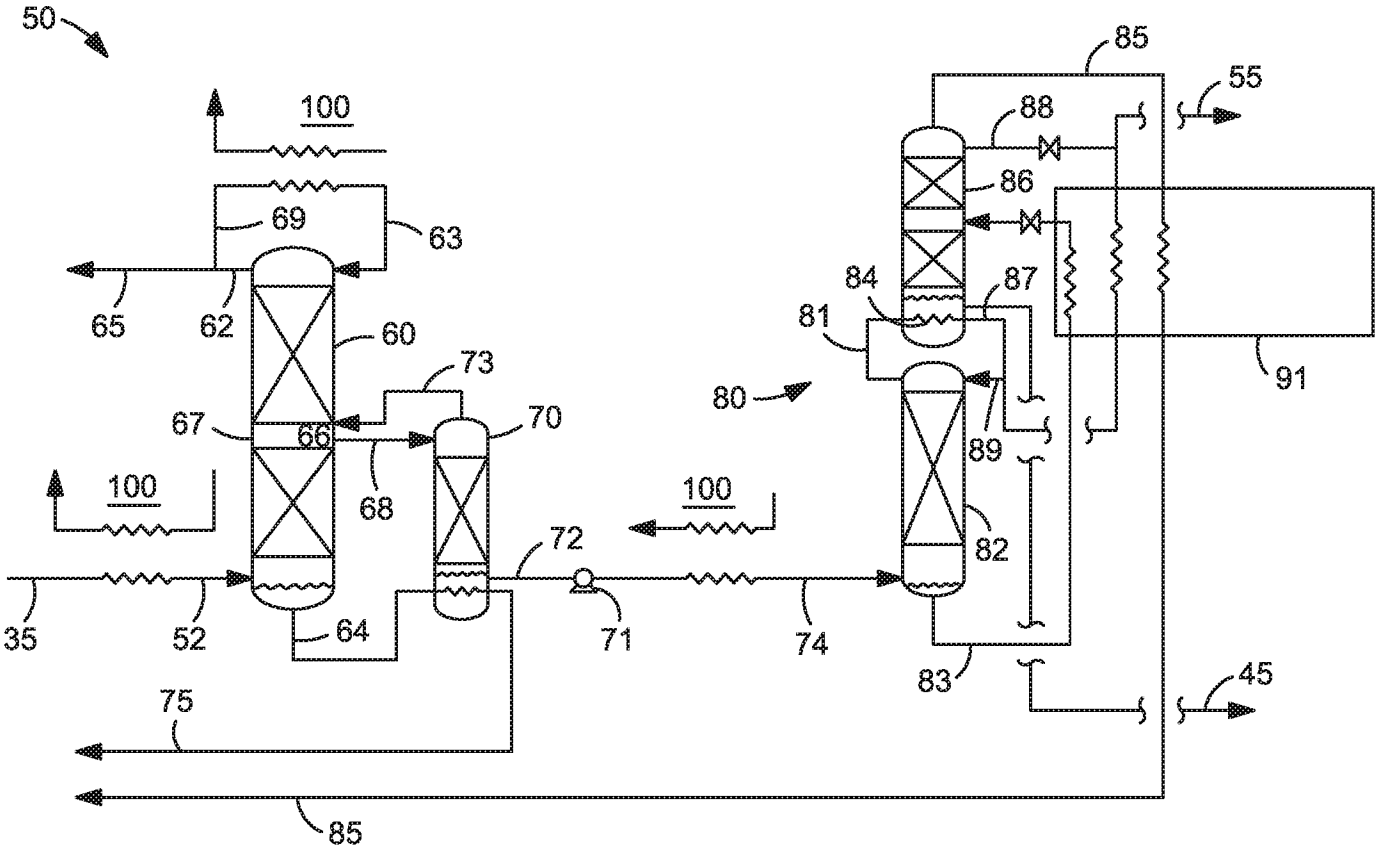
FIG. 2 is a schematic representation of the embodiment of a system and method for argon recovery from the tail gas of an ammonia production plant in accordance with the present invention.

In FIG. 2, there is shown an embodiment of the present system and method for argon and nitrogen recovery from a feed stream 35 comprising hydrogen, nitrogen, methane and argon. The stream is typically obtained at low-pressure such as the tail gas of a Braun Purifier based ammonia production plant. The feed stream 35 to the present system and method is preferably a dry, low pressure (e.g., 15 psig to 25 psig) mixture of predominately hydrogen, nitrogen, methane, and argon. The gas is typically derived from a cryogenic purifier positioned just upstream to the synthesis gas compression in an ammonia synthesis or production plant. The low pressure feed gas stream may comprise the waste gas from the Braun purifier, which, as described above constitutes about 6.3% hydrogen, 76.3% nitrogen, 15.1% methane, and 2.3% argon and on a molar basis. Since the feed stream 35 is obtained dry from a previous cryogenic process in the ammonia production plant, pre-purification of the feed gas stream may or may not be required as part of the present argon recovery process and system 50.

The resulting products from the present recovery process and system 50 include: a liquid argon product stream 45; and a liquid nitrogen product stream 55; a hydrogen-nitrogen product gas stream 65 that may be recycled back to the ammonia plant synthesis section, and more particularly the ammonia synthesis gas stream upstream of the compressor or of the ammonia plant; a high methane content fuel gas 75 that may be recycled back to the ammonia production plant and preferably to the steam reforming section of the ammonia plant, and more specifically to the furnace by which the primary reformer is fired; and a substantially pure nitrogen gaseous overhead stream 85 that is also preferably recycled back to the ammonia plant.

Referring again to FIG. 2, the basic separation approach entails processing at least a portion of the bottoms/waste from the cryogenic purifier of the ammonia plant as a the feed stream 35. In order to effectively operate the Braun Purifier, it is often necessary to partially vaporize the bottoms/waste fluid in an overhead condenser to attain an acceptable temperature difference for subsequent heat exchange. After partial vaporization, a substantial portion of the argon or other inerts are contained in the residual/unvaporized liquid portion of the waste stream. Therefore, an initial step, but not essential step, in the present system and method of argon recovery is to preferably vaporize the residual liquid portion of the feed stream 35 via indirect heat exchange within the refrigeration system 100 to generate a substantially gaseous feed stream 52.

It should be noted that in some instances that residual carbon oxides at levels less than about 10.0 ppm or other unwanted impurities may accompany the feed stream 52 being directed to the auxiliary rectification column 60. In such circumstances, adsorbents and associated purification systems (not shown) can be employed to further remove such impurities from the feed streams 35, 52. Such purification may be conducted while a portion of the feed stream 35 is in the liquid phase upstream of the vaporization step or when the feed stream 52 in the predominately gas phase downstream of the vaporization step.

In a preferred mode of operation, the feed stream 35 exiting the Braun Purifier overhead condenser of the ammonia plant is conditioned in a refrigeration circuit or system 100 by first warming and substantially vaporizing the feed stream 35 and then subsequently cooling the vaporized stream to bring the feed stream to a point near saturation and suitable for entry into the rectification column 60. Alternatively, the step of conditioning the feed stream may comprise any combination of warming, cooling, prepurification, compressing or expanding the feed gas stream to a near saturated vapor state at a pressure of less than or equal to about 150 psia and a temperature near saturation. Preferably the pressure is less than or equal to about 50 psia, and more preferably to a range of between about 25 psia and 40 psia.

The conditioned and cooled feed gas stream 52 is then directed to an auxiliary rectification column 60 where it is rectified into an argon-depleted, hydrogen-nitrogen gas overhead 62 and a methane-rich liquid column bottoms 64. The argon-depleted, hydrogen-nitrogen gas overhead 62 contains primarily nitrogen and hydrogen in a molar ratio (N2:H2) of greater than about 3:1 and preferably greater than about 7:1. The exact composition of the argon-depleted, hydrogen-nitrogen gas overhead 62 will depend upon the level of argon recovery desired. In addition, an argon-rich side draw 66 is produced at an intermediate location 67 of the auxiliary rectification column 60, where it is extracted to form an argon-rich stream 68 having trace amounts of hydrogen.

A portion of the argon-depleted, hydrogen-nitrogen gas overhead 62 is preferably directed or recycled back to the ammonia plant as a hydrogen-nitrogen product gas stream 65 while another portion 69 is directed to the refrigeration system 100 where it is condensed and reintroduced as a reflux stream 63 to the auxiliary rectification column 60. Specifically, the portion of the hydrogen-nitrogen product stream 65 is directed back to the cryogenic purifier (e.g.

Braun Purifier) in the ammonia plant or recycled back to the synthesis gas stream in the ammonia plant upstream of the compressor. Similarly, all or a portion of the methane-rich liquid column bottoms 64 is preferably subcooled and directed back or recycled back to fire the reformer as fuel gas stream 75.

A key element of the present recovery process and system 50 is the extraction of an argon rich side draw 66 at a location above the point where methane is present in any appreciable amount, for example a location of the auxiliary rectification column where the methane concentration is less than about 1.0 part per million (ppm) and more preferably less than about 0.1 ppm. The argon-rich liquid stream 68 with trace amounts of hydrogen is extracted from an intermediate location 67 of the auxiliary rectification column 60 and directed to a hydrogen rejection arrangement shown as a hydrogen stripping column 70 which serves to reject trace hydrogen from the descending liquid. The resulting hydrogen free stream 72 exiting the hydrogen rejection arrangement comprises argon and nitrogen containing stream that is free of both methane and hydrogen.

An optional feature of the hydrogen rejection arrangement, and more specifically the hydrogen stripping column 70, is that the resulting overhead vapor 73 or the rejected hydrogen and methane can be returned to the auxiliary rectification column 60. Alternatively, the rejected hydrogen and methane stream 73 can be vented or combined with virtually any other exiting process stream.

The argon-rich liquid stream 72 free of both methane and hydrogen is then directed to a further separation wherein at least an argon stream is generated by way of distillation. Alternatively the argon-rich stream 72 could be taken directly as a merchant product or transported to an offsite refinement process, where it could later be separated into a merchant argon product and optionally nitrogen products. However, in the presently disclosed embodiment shown in FIG. 2, the argon rich stream 72 is pressurized via pump 71 and then at least partially vaporized or fully vaporized. The pressurized hydrogen-free, nitrogen and argon containing stream 74, in a predominately vapor form, is then directed to a thermally linked double column system 80 configured for separating the argon-rich stream 74 and producing a liquid argon product 45 and a pure nitrogen overhead 85.

In the double column distillation system 80, the hydrogen-free, nitrogen and argon containing stream 74 is first rectified in a higher pressure column 82 to produce a substantially nitrogen rich overhead 81 and an argon enriched bottoms fluid 83. The nitrogen rich overhead 81 is directed to the condenser reboiler 84 disposed in the lower pressure column 86 where it is condensed to a liquid nitrogen stream 87. This liquid nitrogen stream 87 from the condenser-reboiler 84 and argon enriched bottoms fluid 83 from the higher pressure column 82 are preferably subcooled in subcooler 91 against a cold stream which could be a low pressure nitrogen rich stream 85 or a separate refrigeration stream. Portions of the liquid nitrogen stream exiting condenser/reboiler 84 88, 89 are used as reflux to the lower pressure column 86 and higher pressure column 82 while another portion of the liquid nitrogen stream may be diverted to storage (not shown) as a liquid nitrogen product 55. A portion of the nitrogen reflux stream 88 and the subcooled argon enriched bottoms fluid 83 are then directed to the lower pressure distillation column 86 where they are distilled into a substantially pure nitrogen overhead gas 85 and an argon rich liquid product 45. The argon rich liquid product 45 can optionally be further subcooled prior to flashing to storage (not shown).

The substantially pure nitrogen overhead 85 may be directed to a warming vent, an expansion circuit, or may be directed as a make-up gas to a refrigeration circuit 100 associated with the present system 50 to produce the refrigeration required for the disclosed process. Alternatively, the substantially pure nitrogen overhead 85 could be directly taken as cold nitrogen gaseous product, liquefied and taken as a cold liquid nitrogen product, or recycled back to the ammonia plant.

The resulting substantially pure nitrogen overhead 85 from the lower pressure column 86 can be directed to any number of locations/uses including: (i) to sub-cool the liquid nitrogen reflux streams and/or the argon enriched bottoms fluid; (ii) directly taken as cold nitrogen gaseous product; (iii) to a liquefaction system and taken as a cold liquid nitrogen product; (iii) as a make-up working fluid or component thereof in a refrigeration system; (iv) to the cryogenic purifier (e.g. Braun Purifier) of the ammonia plant. Preferably, the separated nitrogen stream can returned to the point of origin without a substantial portion of the original argon content. In a preferred mode of operation of the present nitrogen-argon separation system 50 depicted in FIG. 2, the resulting nitrogen overhead 85 will be of sufficient pressure to be recombined with the methane enriched stream associated with the Braun Purifier. Alternatively, the nitrogen overhead 85 could be recycled or directed back to other locations in the ammonia plant upstream of the cryogenic purifier to be mixed with various feed streams to the ammonia production process or locations downstream of the cryogenic purifier and into the synthesis gas train.

Advantageously, the above-described system and method is configured to capture the bulk of the contained argon contained in the feed gas stream and can recover liquid nitrogen or even gaseous nitrogen on an as needed basis. The base level of argon recovery of the presently illustrated and described systems and processes are in the range of about 85% to about 90%. Another advantage of the present system and method is that the initial rejection of methane by way of the auxiliary rectification column and rejection of hydrogen by the hydrogen stripping column is accomplished at or near the feed gas stream pressures (i.e. less than or equal to about 150 psia, and more preferably less than or equal to 50 psia, and still more preferably in the range of about 25 to 40 psia) which promotes the simplicity and cost effectiveness of argon recovery.

Figure 3:
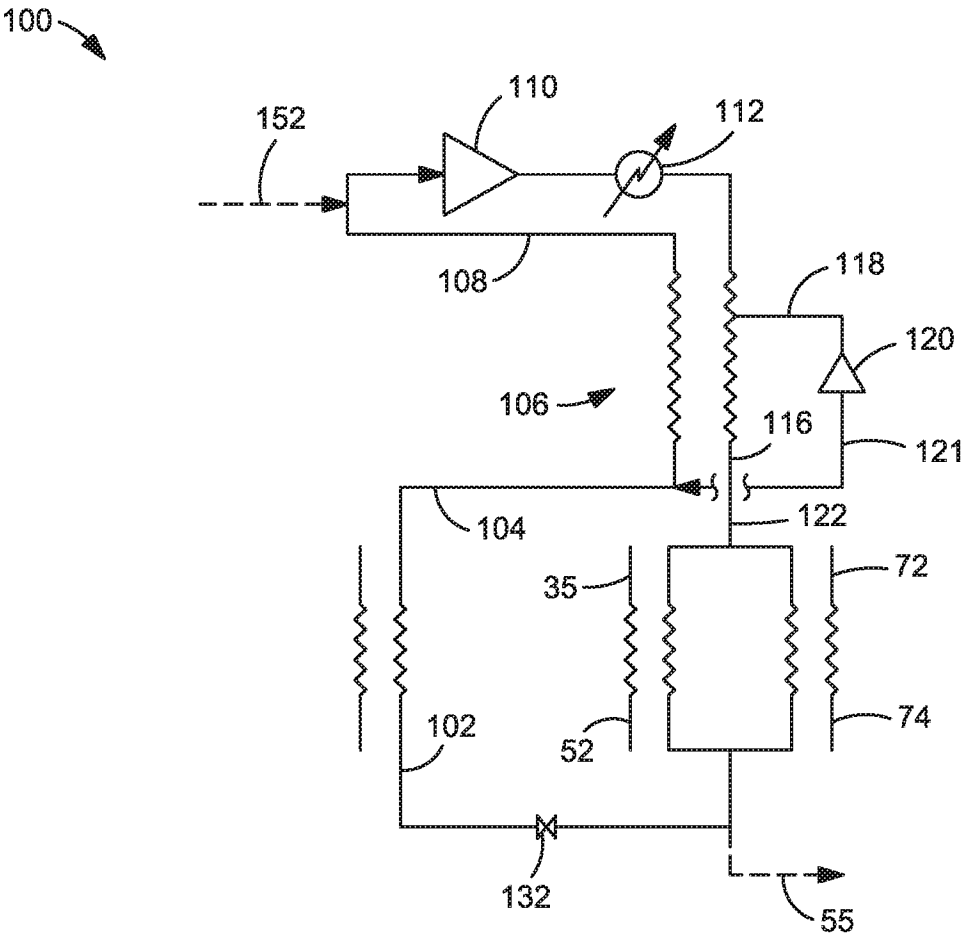
FIG. 3 is a schematic representation of the refrigeration system suitable for use with the embodiment depicted in FIG. 2.

Turning now to FIG. 3, an embodiment of the refrigeration circuit or system 100 forming part of the conditioning system is depicted. In order to produce additional refrigeration and to facilitate the above-described separations, an integrated a refrigeration system or liquefaction system can be employed. The preferred conditioning and refrigeration system 100 and process is configured to achieve or produce the following: (1) a low pressure refrigeration stream 102 sufficiently cold to refrigerate the argon-depleted, hydrogen-nitrogen gas overhead 65 of the auxiliary rectification column 60; (2) a vaporized refrigerant stream 104, after having cooled the argon-depleted, hydrogen-nitrogen gas overhead 65, is then substantially warmed to ambient temperatures in a heat exchanger 106 and the warmed stream 108 is compressed in a single stage or multi-stage compressor 110 to an elevated pressure and cooled in aftercooler 112; (3) at least a portion of the elevated pressure refrigerant 118 is expanded in turbo-expander 120 to produce refrigeration; (4) another portion of the elevated pressure refrigerant 116 is cooled to near saturation via indirect heat exchange with at least a portion of the low pressure refrigerant stream in the heat exchanger 106 to produce a cooled, elevated pressure refrigerant stream 122; (5) the cooled, elevated pressure refrigerant stream 122 is at least partially condensed against either the incoming feed stream 35 and/or the partially vaporizing hydrogen-free, nitrogen and argon containing stream 72; and (6) at least a portion of the partially condensed or fully condensed refrigerant 130 is valve expanded in valve 132 to form the low pressure refrigeration stream 102 used to refrigerate the argon-depleted, hydrogen-nitrogen gas overhead 65 of the auxiliary rectification column 60.

It should also be noted that the above refrigeration circuit or system 100 can also be operated as a liquefaction system. The key difference in the liquefaction system being that a portion of the working fluid may also be delivered as a liquid product 55. In particular, the use of the substantially pure nitrogen overhead 85 from the lower pressure column 86 of the double column distillation system 80 as a working fluid or make-up gas 152 is ideal. In such liquefaction embodiment, a liquid nitrogen product stream 150 could be extracted from the refrigeration system 100 rather than from the double column distillation system 80 and equivalent volume of make-up refrigerant 152, such as a portion of the nitrogen overhead 85 from the double column distillation system 80 would be added to the refrigeration system 100.

With respect to the above-described refrigeration system, it is also possible to incorporate multiple stages of compression and/or use multiple compressors arranged in parallel for purposes of accommodating multiple return pressures. In addition, the turbo-expanded refrigerant stream 121 can be configured interior with respect to temperature in the heat exchanger 106 as the turbine discharge or exhaust does not have to be near saturation. The shaft work of expansion can be directed to an additional process stream or may be used to "self-boost" the expansion stream. Alternatively, the shaft work of expansion may also be loaded to a generator or dissipated by a suitable break.

As for the composition of the working fluid in the refrigeration circuit or system, a stream of high purity nitrogen is a natural choice. However it may be advantageous to use a combination of nitrogen and argon or even pure argon. It should also be noted that the presence of air compression for secondary reforming in the ammonia plant can be exploited to supply a working fluid for refrigeration, with such working fluid being air or constituents of air. As noted, a liquid product stream can be generated directly from the working fluid of the refrigeration system. Refrigerant makeup for liquid production or turbo-expander leakage may be supplied by the nitrogen-argon separation system or it may be supplied externally from a storage tank or nearby air separation plant.

It is also possible to supplement refrigeration generation of the disclosed refrigeration system with the inclusion of a Rankine cycle, vapor compression type refrigeration circuit to provide supplemental warm level refrigeration. Alternatively, a second turbo-expander or warm turbine can be employed which may also use the subject working fluid or a different working fluid, such as carbon dioxide or ammonia to supply yet additional refrigeration (alone and in combination). Such gases can be easily derived from the base ammonia processing sequence in the ammonia plant.

With reference again to FIGS. 2 and 3, one can appreciate that incorporating or adopting the present nitrogen-argon separation process and system within an ammonia production operation allows the plant operator to also optimize or modify the Braun Purifier operation within the ammonia plant to accommodate the separate nitrogen and methane rich streams from the above-described recovery system as well as any excess nitrogen and argon from the hydrogen free, nitrogen and argon containing stream. For example, when retrofitting an existing Braun purifier based ammonia plant, not all of the feed need be processed for argon recovery and the present system can be sized to recover a desired volume of high purity argon and/or high purity nitrogen. Any nitrogen or argon not recovered as high purity gases or liquids can be directed back to the Braun Purifier for further warming.

Alternatively, in a new ammonia production facility, it is possible to design the cryogenic purifier to independently warm the streams returning from the above-described separation process using a customized or specially designed heat exchanger. Furthermore, the ratio of turbo-expansion of the expander used in the Braun Purifier process can be reduced or perhaps even eliminated by way of the refrigeration generated from the present system and method. In essence, the refrigeration systems of the present nitrogen-argon separation process and system may be integrated with the refrigeration system in the Braun Purifier process.

Figure 4:
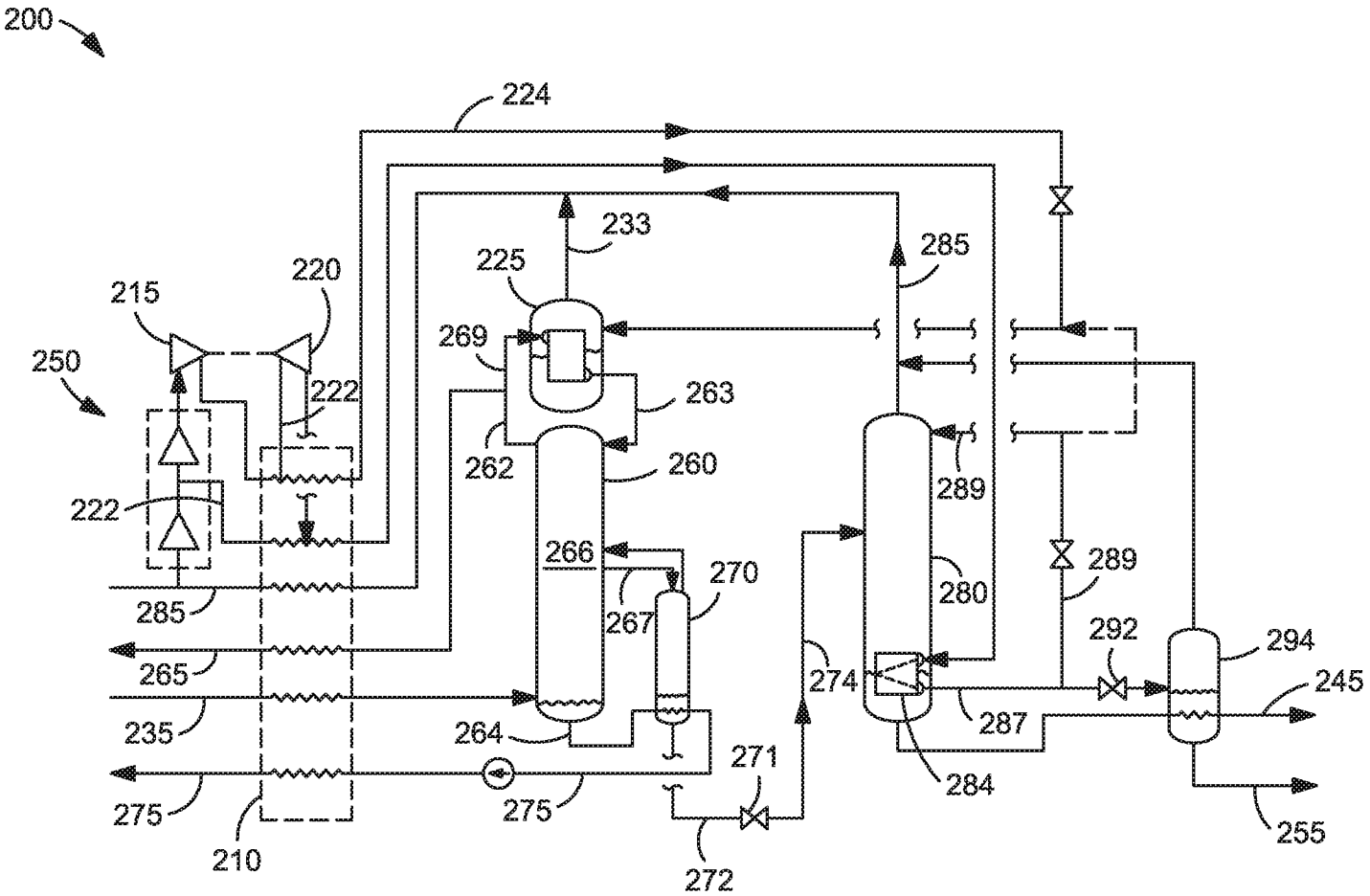
FIG. 4 is a schematic representation of an alternate embodiment of a system and method for argon recovery from the tail gas of an ammonia production plant.

Turning now to FIG. 4, there is shown an alternate embodiment of the present system 200 and method for argon and nitrogen recovery from a low-pressure tail gas of an ammonia production plant. In a broad sense, this alternate embodiment also includes the basic steps of: (i) conditioning the feed gas stream in a refrigeration circuit or subsystem; (ii) separating the conditioned feed gas stream in a rectification column to produce a methane-rich liquid column bottoms; an argon-depleted, hydrogen-nitrogen gas overhead; and an argon-rich stream containing nitrogen and argon with trace amounts of hydrogen; (iii) stripping the trace amounts of hydrogen from the argon-rich stream to produce an argon depleted stream and a hydrogen-free, nitrogen and argon containing stream; and (iv) separating the argon from the hydrogen-free, nitrogen and argon containing stream in a distillation column system, with liquefaction to produce liquid products, namely liquid argon and liquid nitrogen.

The refrigeration circuit or system of the embodiment of FIG. 4 comprises a heat exchanger 210 that cools the feed stream 235 via indirect heat exchange with a low pressure nitrogen waste stream 285, the hydrogen-nitrogen product stream 265, and the high methane content fuel gas 275. The feed stream 235 is preferably cooled in the heat exchanger 210 to near saturation and then directed to a low pressure auxiliary rectification column 260 where the feed stream 235 is subjected to a rectification process. Within the refrigeration circuit or system, an integrated nitrogen based heat pump or recycle and compression circuit may also be provided to supply the necessary refrigeration to produce the liquid products, namely a liquid argon product stream 245 and a liquid nitrogen product stream 255. Specifically, the recycle compression circuit 250 compresses a portion of the waste nitrogen stream 285 from a pressure of about 24 psia to a pressure of about 650 psia. A partially compressed side nitrogen draw 222A may be extracted at a pressure of about 78 psia from an intermediate location of the recycle compressor train 250 or alternatively from the discharge of the turbine 220. The side nitrogen draw 222 is subsequently cooled in heat exchanger 210. In the illustrated embodiment, the subject pressure and temperature of the side nitrogen draw 222A must be is sufficient to reboil the liquids at the bottom of distillation column 280. Also, in order to attain high liquefaction efficiency, supplemental refrigeration is further provided via the use of a cryogenic nitrogen turbine configured to operate between the recycle discharge and the moderate pressure required of the reboiler 284.

In the embodiment of FIG. 4, the configuration of the turbine outlet temperature is ideally above the cold end temperatures of the heat exchanger 210. The vaporization of the auxiliary rectification column bottoms allows a substantial warming of the turbine 220 and an increase in overall liquefaction efficiency. It should be noted, however, that the turbine 220 need not be directly coupled to a recycle booster compressor 215 as illustrated, but rather, the turbine shaft work may be directed to a generator or other process compression. The turbine pressure levels may also be configured across lower pressure recycle compression stages; however this would increase the size of the heat exchanger 210 and increase the associated power consumption.

A stream of liquid nitrogen 224 is generated from the heat exchanger 210 by cooling and condensing a fraction of the higher pressure nitrogen recycle stream. The liquid nitrogen stream is extracted from the cold end of the heat exchanger 210 and, as described in more detail below, serves to refrigerate condenser 225 associated with rectification column 260. Alternatively, a portion of the condensed liquid nitrogen stream from the heat exchanger 210 may be directed to storage or used as reflux 289 in the distillation column 280.

In some applications of the present system and methods, where liquid nitrogen production exceeds the local demand, the excess liquid nitrogen can be directed to condenser 225 (shown as the dotted line) and vaporized in condenser 225 with a resulting decrease in overall power consumption. Conversely, depending upon local gaseous nitrogen product demands, it is possible to configure the recycle compression circuit 250 to provide gaseous nitrogen product at a range of pressures.

Within the methane removal subsystem, methane is removed from the ascending vapor within auxiliary rectification column 260 and extracted as a bottoms liquid 264. The extracted methane-rich bottoms liquid 264 comprising about 84% methane is preferably subcooled and the subcooled methane-rich liquid stream 275 directed back to the heat exchanger 210 where it is vaporized. Cold end refrigeration is thus effectively generated by way of the vaporization of the methane-rich (e.g., ~84% methane) bottoms liquid of auxiliary rectification column 260. The vaporized methane-rich stream 275 is then preferably recycled as a fuel gas back to the steam reforming section of the ammonia product plant (not shown).

The auxiliary rectification column 260 is further staged to remove most all of the argon from the feed gas stream leaving a nitrogen-rich overhead gas 262. A portion of the nitrogen-rich overhead gas 269, which contains roughly 90% nitrogen, is directed to a condenser-reboiler 215 where it is condensed against a liquid nitrogen stream to produce a nitrogen rich reflux 263 that is re-introduced to rectification column 260. Another portion of the nitrogen-rich overhead gas from column 260 is diverted as the hydrogen-nitrogen product gas 265 that warmed in the heat exchanger 210 and then may be recycled back to the ammonia synthesis section of the ammonia product plant. The vaporized portion of the nitrogen stream 233 from the condenser-reboiler 215 is combined with the waste nitrogen gas 285 and directed to the heat exchanger 210 where it is warmed to about ambient temperature.

Given sufficient staging in the rectification column 260, argon accumulates above the methane removal section, which are generally the bottommost 15 to 20 stages in column 260. A side liquid argon draw 266 is extracted from a point above the methane removal section approximately midway up the rectification column 260 to form an argon-rich stream 267. The argon-rich stream 267 is preferably in liquid form and will typically contain trace amounts of hydrogen. The argon recovery can be enhanced even further by way of reboiling within rectification column, albeit at the expense of additional operating costs associated with the additional compression power required.

As seen in FIG. 4, the argon-rich stream 267 is then directed to the hydrogen removal arrangement which is shown as a small side stripper column 270 where the trace amounts of hydrogen in the argon-rich stream 267 are removed. The small side stripper column 270 preferably includes between about 4 and 7 stages of separation, with the stripped hydrogen being returned to the auxiliary rectification column 260 via stream 273, discharged to vent or sent to a fuel header while the nitrogen and argon containing stream 272, substantially free of hydrogen, is removed from small side stripper column 270, valve expanded in valve 271 and then introduced as stream 274 to the argon and nitrogen distillation column 280. The staging of the side stripper column 270 may vary depending upon the specification of product nitrogen. In some applications, the hydrogen separation may even be performed using any available hydrogen removal technologies including, for example, a falling film type evaporator or even a combination of the hydrogen stripping column and an evaporator.

The hydrogen-free, argon and nitrogen containing liquid is then directed to a distillation column 280 which serves to separate the nitrogen and argon. This distillation column 280 is preferably comprised of both a stripping section and a rectification section. The distillation column 280 produces a pure nitrogen overhead stream 285 a portion of which is preferably recycled to the heat exchanger 210 and then returned to the ammonia production plant. Distillation column 280 also includes a reboiler 284 configured to reboil the argon with a moderate pressure nitrogen gas stream to produce an ascending argon vapor and a liquefied nitrogen stream 287. A first portion of the liquefied nitrogen stream may be depressurized via valve 292 and then directed to combined phase separator-subcooler vessel 294 or outside use. A second portion of the liquefied nitrogen 289 is employed as reflux to distillation column 280. An additional fraction of the liquid nitrogen may be used supplement the refrigeration for the condenser 225. A liquid argon product stream 245 is extracted from a location near the bottom of distillation column 280. The liquid argon 245 may be further subcooled prior to being directed to suitable storage means or outside use. Also, while distillation column 280 typically operates at low pressure of between about 25 psia to about 30 psia, it is possible to operate distillation column 280 at an even lower pressure with an increase in the complexity and size of the recycle compression circuit.

In some embodiments, the methane, nitrogen, hydrogen and argon containing feed stream 235 may be pre-purified and/or compressed prior to entry to the heat exchanger. Similarly, the methane-rich bottoms liquid 264 may be adjusted in pressure prior to vaporization in the heat exchanger, by way of a pump, valve or static head. Also, depending upon the reforming train in the ammonia production plant, the hydrogen-nitrogen overhead from rectification column 260 could be recombined with the methane-rich bottoms liquid 264 and then recycled back to the ammonia production plant as a fuel gas to fire the primary steam reformer. This mixing of the hydrogen-nitrogen overhead stream with the methane-rich stream can be done prior to or after warming in the primary or main heat exchanger. Alternatively, the hydrogen-nitrogen overhead stream may be compressed and reintroduced into the synthesis gas train.

Another alternative embodiment of the present system and method of argon recovery from the tail gas of an ammonia production plant is contemplated wherein the hydrogen stripping or rejection column 270 may be simplified or even replaced with a phase separator or phase separation supplemented with a small amount of heat. It is also conceivable that the refrigeration circuit composition can be made to be independent from the distillation column 280 overhead composition. However, this will require an additional condenser associated with distillation column 280 as well as a reconfiguration of the liquid nitrogen process draw. Although not preferred, the operating pressure of distillation column 280 can be higher than the operating pressure of rectification column 260 if a liquid pump is used to direct the hydrogen free, argon and nitrogen containing liquid stream from side stripping column 270 to distillation column 280.

Figure 5:
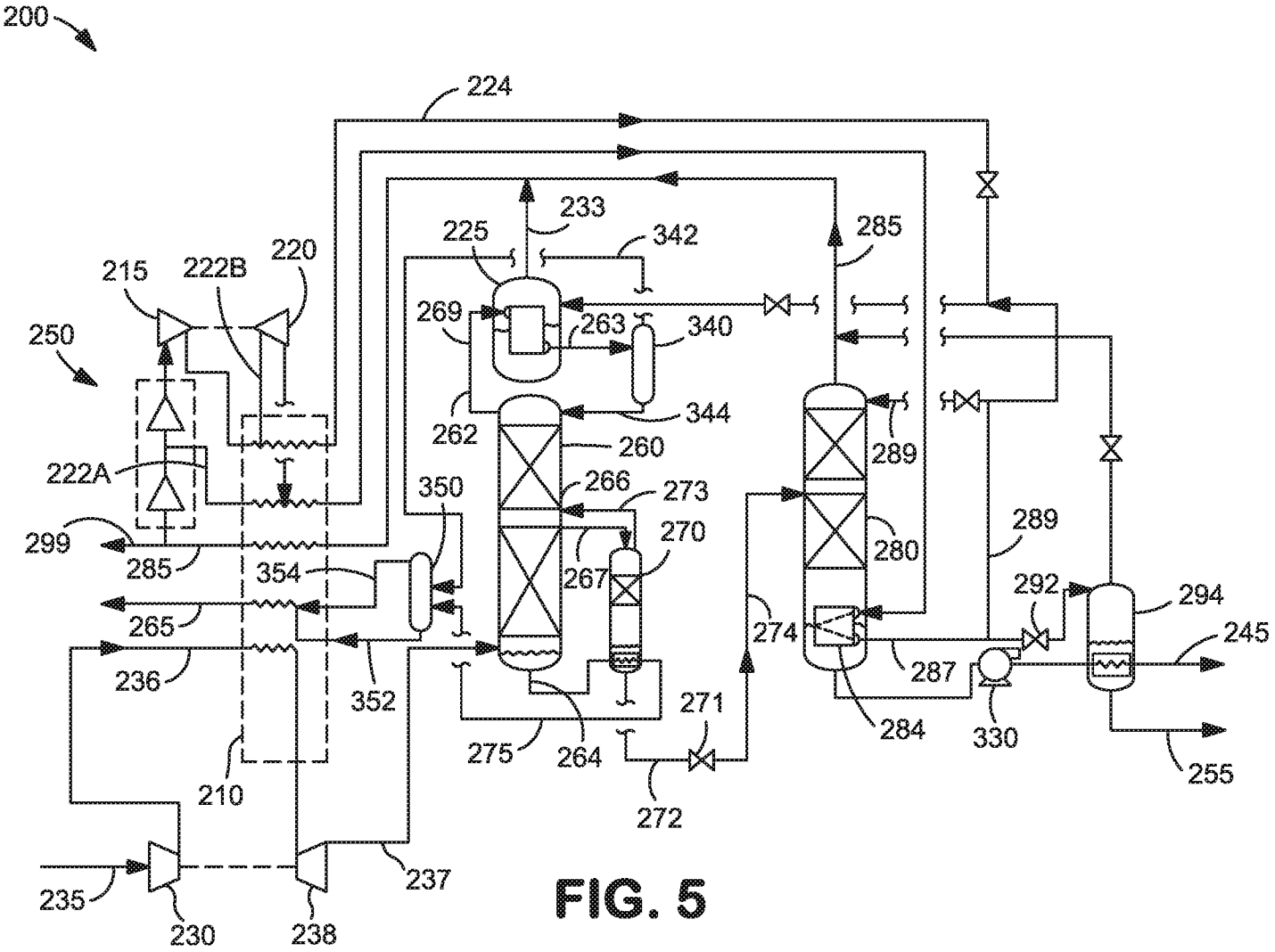
FIG. 5 is a schematic representation of another embodiment of a system and method for argon recovery from the tail gas of an ammonia production plant.

Turning now to FIG. 5, there is shown another embodiment of the present system and method for argon and nitrogen recovery from a feed stream comprising hydrogen, methane, nitrogen and argon, such as a low-pressure tail gas of an ammonia production plant. Hydrogen rejection, argon recovery and nitrogen recovery in the embodiment of FIG. 5 is in many ways the same as or similar to the hydrogen rejection, basic argon recovery and nitrogen recovery systems and processes disclosed above with reference to FIG. 4 to produce a pumped (via pump 330) and subcooled, high purity liquid argon stream 245 and high purity liquid nitrogen product stream 255. The main differences between the embodiment of FIG. 5 and the previously described embodiment of FIG. 4 relates to the power benefits associated with the embodiment of FIG. 5 and the production of a high quality fuel gas stream at sufficient pressure for return to the ammonia synthesis process.

As seen in FIG. 5, a pressurized feed stream 235, preferably a feed gas stream between 50 psia and 150 psia, is directed to a turbine driven booster compression stage. The compressed feed gas stream 235 is compressed in compressor 230, partially cooled in heat exchanger 210 and expanded, generally in the range of about 40 psia to about 80 psia in turboexpander 238. The expanded feed gas stream 237 is then directed to the rectification column 260 where it is rectified to produce an argon depleted nitrogen-rich overhead gas 262, a methane rich column bottoms 264 and an argon/nitrogen rich side draw 267 from an intermediate location 266 of the rectification column 260. The side draw 267 is preferably in liquid form but alternatively may be in gaseous form or a two-phase stream.

Specifically, the nitrogen-rich overhead gas 262, 269, which preferably contains roughly 90% nitrogen, is directed to a condenser-reboiler 215 where it is partially condensed against a liquid nitrogen stream. The partially condensed nitrogen-rich stream 263 that is directed to a phase separator 340 which separates the stream 263 into a liquid fraction 344 which is re-introduced to rectification column 260 as reflux and a vapor fraction 342 which is directed to another phase separator 350 where it is mixed with the methane rich liquid stream 275 to form the two phase fuel stream. The vapor portion of the two-phase fuel stream 354 is directed to a common passage in the multi-passage heat exchanger 210. The liquid portion of the two phase fuel stream 352 exiting the phase separator 350 is also directed to the same common passage in the heat exchanger, albeit a downstream location of the common passage. The vaporized portion of the nitrogen stream 233 from the condenser-reboiler 215 is combined with the waste nitrogen gas 285 and directed to the heat exchanger 210 where it is warmed to about ambient temperature. In lieu of the phase separator 350, it is contemplated that a static in-line mixer could be used to mix the vapor fraction 342 of the partially condensed nitrogen-rich stream 342 and the methane rich liquid stream 275 to form the two phase fuel stream.

The effect of this fluid mixing in either the phase separator 350 or a static in-line mixer is the drastic lowering of the dewpoint of the two phase fuel stream mixture and thus the vaporization region of the mixture within the primary heat exchanger 210. This, in turn, allows the combined fuel gas stream 265 exiting the primary heat exchanger 210 to be at a higher pressure compared to separate warming of the streams in the primary heat exchanger 210 (as shown in FIG. 4). The resulting mixed fuel gas stream may be further compressed as necessary. The higher pressure fuel gas stream 265 exiting the primary heat exchanger 210 is preferably delivered to or directed to the reforming process of the ammonia plant for purposes of firing the reformer. In some instances it may be used as regeneration gas for prepurification units (not shown).

Figure 6:
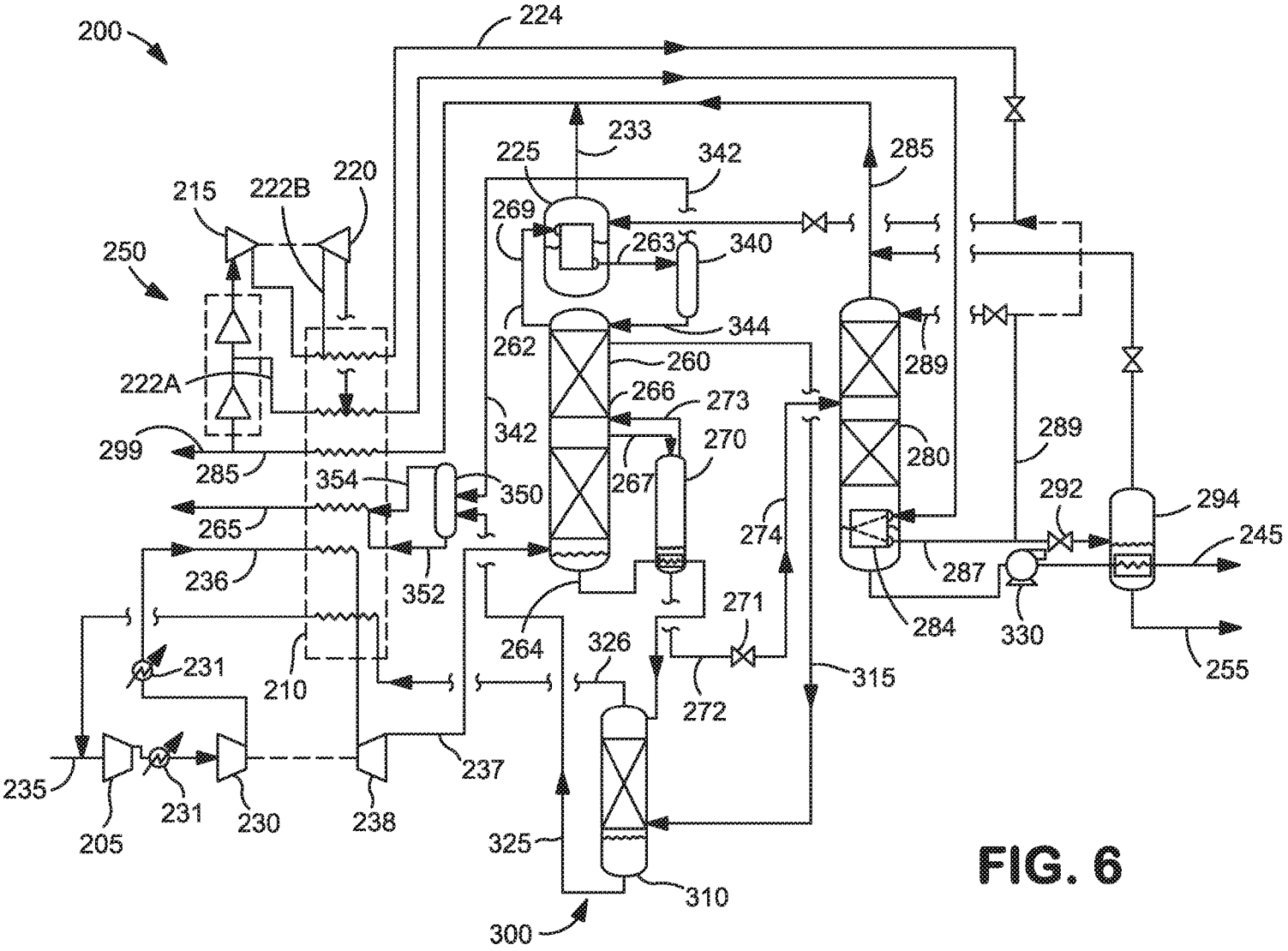
FIG. 6 is a schematic representation of yet another alternate embodiment of a system and method for argon recovery from the tail gas of an ammonia production plant.

In applications where higher recovery of argon is needed or desired, one can boost overall argon recovery by supplemental argon recycle from the methane rich fuel gas stream as shown generally in FIG. 6. The embodiment shown in FIG. 6 is similar in many regards to the embodiment of FIG. 5. Since the methane rich liquid bottoms 264 taken from the rectification column 260 is comprised primarily of methane with some argon of perhaps between 5% and 25% of the argon contained in the incoming feed stream 235. The preferred approach is to 'strip' the argon from the methane rich liquid bottoms 264 in a stripping column arrangement 300. Gas stripping is a term used to describe the countercurrent contacting of vapor and liquid streams wherein a component of the descending liquid is 'stripped' and carried with the ascending vapor flow to the column overhead.

As shown in FIG. 6, argon is stripped form the descending liquid methane rich liquid bottoms 264 in the stripping column 310 with the ascending vapor being an argon-depleted vapor stream 315 such as a portion of the argon depleted nitrogen-rich overhead gas 262 from the rectification column 262. Alternatively, the argon-depleted vapor stream 315 may originate as a stream from nitrogen refrigeration circuit, or the argon column rectification overhead. Whatever the source, the argon-depleted vapor stream 315 may be conditioned by means of any combination of warming, cooling, prepurification, compressing or expanding the argon-depleted vapor stream.

The argon-depleted vapor stream 315 has an argon concentration less than the argon concentration of the methane-rich liquid stream and a dewpoint lower than the methane rich liquid bubble point. The resulting liquid bottoms in the stripping column 310 consists of liquid methane substantially free of argon. A stream 325 of the liquid bottoms is directed to the phase separator 350 where it is mixed with the vapor portion 342 of the partially condensed nitrogen rich stream 263 to form the two phase fuel stream. The vapor fraction 354 and liquid fraction 352 of the two phase fuel stream are directed to the common passage in a multi-passage heat exchanger 210 where it cools the incoming compressed feed gas stream 236 and forms the methane rich fuel gas stream 265. Alternatively, stream 325 and vapor portion 342 of the partially condensed nitrogen rich stream 263 may be warmed separately (and perhaps at different pressures prior to directing the streams to the common passage in a multi-passage heat exchanger 210. The overhead gas 326 from the stripping column 310 contains the stripped argon together with the bulk of the ascending argon-depleted vapor and is recycled back and mixed with the incoming feed stream 235 via the primary heat exchanger 210 to increase the overall argon recovery of the system 200.

In the illustrated embodiment of FIG. 6, the incoming feed stream 235 is optionally compressed in one or more compressors 205, 230, preferably turbine driven compressors, and cooled with intercoolers/aftercoolers 231 to form a high pressure feed stream 236 that is partially cooled in the primary heat exchanger 210. After partial cooling in the primary heat exchanger 210, the feed stream 236 shown in FIG. 6 is then expanded in turbo-expander 238 to generate refrigeration with the resulting lower pressure feed stream 237 being directed to the base of the rectification column 260. Alternatively, the incoming feed stream 235 may be cooled directly and refrigeration is generated solely from the refrigeration circuit.

While the present invention has been described with reference to one or more preferred embodiments and operating methods associated therewith, it should be understood that numerous additions, changes and omissions to the disclosed system and method can be made without departing from the spirit and scope of the present invention as set forth in the appended claims.

What is claimed is:

1. A system for recovery of argon from a feed stream comprising hydrogen, nitrogen, methane and argon, the system comprising:

a conditioning circuit configured for conditioning the feed stream to a temperature suitable for rectification and at pressure less than or equal to about 400 psia;

at least one rectifying column configured to receive the conditioned feed stream and produce an argon depleted, nitrogen rich vapor stream, an argon enriched side draw, and a methane-rich liquid stream;

an argon stripping column configured to receive the methane rich liquid stream and strip argon from the methane rich liquid stream using the argon depleted, nitrogen rich vapor stream and produce an argon depleted methane rich liquid from the bottom of the argon stripping column and an argon containing overhead gas from the top of the argon stripping column;

a recycle circuit configured for extracting the argon containing overhead gas from the argon stripping column and mixing the argon containing overhead gas with the feed stream; and a distillation column arrangement configured to receive the argon enriched stream and produce a high purity argon stream and a nitrogen overhead gas stream.

2. The system of claim 1, wherein the feed stream is a feed synthesis gas stream that contains greater than about 50% nitrogen by mole fraction.

3. The system of claim 1, wherein the feed stream is a tail gas from an ammonia plant and the argon depleted methane rich liquid is suitable for use as a fuel gas in the ammonia plant.

4. The system of claim 1, wherein the conditioning circuit further comprises a main heat exchanger configured to warm the recycled argon containing overhead gas via indirect heat exchange with the feed stream prior to mixing the argon containing overhead gas with the feed stream.

5. The system of claim 1, further comprising a compressor configured to compress the recycled argon containing overhead gas prior to mixing the argon containing overhead gas with the feed stream.

6. The system of claim 1, wherein the argon depleted, methane rich liquid stream is combined with a portion of the argon depleted nitrogen enriched vapor to form a two phase fuel stream.

7. The system of claim 6, wherein the conditioning circuit further comprises a main heat exchanger configured to vaporize the two phase fuel stream via indirect heat exchange with the feed stream.

8. The system of claim 1, further comprising a hydrogen stripping column configured to receive the argon enriched stream and strip hydrogen from the argon enriched stream to produce a hydrogen-free argon enriched stream, wherein the hydrogen-free argon enriched stream is directed to the distillation column arrangement as the argon enriched stream.

9. A system for recovery of argon from a feed stream comprising hydrogen, nitrogen, methane and argon, the system comprising:

a conditioning circuit configured for conditioning the feed stream to a temperature suitable for rectification and at pressure less than or equal to about 400 psia;

at least one rectifying column configured to receive the conditioned feed stream and produce an argon depleted, nitrogen rich vapor stream, an argon enriched side draw, and a methane-rich liquid stream;

a hydrogen stripping column configured to receive the argon enriched stream and strip hydrogen and methane from the argon enriched stream to produce a hydrogen and methane rejection gas stream and a hydrogen-free argon enriched stream; and a distillation column arrangement configured to receive the hydrogen-free argon enriched stream and produce a high purity argon stream and a nitrogen overhead gas stream.

10. The system of claim 9, wherein the feed stream is a feed synthesis gas stream that contains greater than about 50% nitrogen by mole fraction.

11. The system of claim 9, wherein the feed stream is a tail gas from an ammonia plant and the argon depleted methane rich liquid is suitable for use as a fuel gas in the ammonia plant.

12. The system of claim 9, further comprising a subcooler arrangement configured for subcooling the argon depleted methane rich liquid stream.

13. The system of claim 12, wherein the subcooled argon depleted methane rich liquid stream is combined with a portion of the argon depleted nitrogen enriched vapor to form a two phase fuel stream.

14. The system of claim 13, wherein the conditioning circuit further comprises a main heat exchanger configured to vaporize the two phase fuel stream via indirect heat exchange with the feed stream.

15. The system of claim 9, wherein the conditioning circuit further comprises a main heat exchanger configured to vaporize the argon depleted methane rich liquid stream via indirect heat exchange with the feed stream.

16. The system of claim 9, wherein the distillation column arrangement further comprises a double column distillation system having a higher pressure column, a lower pressure column, and a condenser-reboiler.

17. The system of claim 9, wherein the distillation column arrangement further comprises a single column having a stripping section and a rectification section.

* * * * *